US008196258B2

(12) United States Patent
Seo

(10) Patent No.: US 8,196,258 B2
(45) Date of Patent: Jun. 12, 2012

(54) BRUSH ASSEMBLY AND VACUUM CLEANER HAVING THE SAME

(75) Inventor: Ji-ho Seo, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 986 days.

(21) Appl. No.: 12/183,176

(22) Filed: Jul. 31, 2008

(65) Prior Publication Data

US 2009/0235483 A1 Sep. 24, 2009

(30) Foreign Application Priority Data

Mar. 19, 2008 (KR) ..... 10-2008-0025613

(51) Int. Cl.
*A47L 9/06* (2006.01)

(52) U.S. Cl. ..... 15/364; 15/365; 15/367; 15/373

(58) Field of Classification Search ..... 15/365, 15/367, 368, 373, 402; *A47L 5/00, 9/06*
See application file for complete search history.

(56) References Cited

U.S. PATENT DOCUMENTS 7,998,277 B2 * 8/2011 Nguyen ..... 134/21

FOREIGN PATENT DOCUMENTS

GB 2072495 A 10/1981
KR 10-2008-0033048 4/2008

* cited by examiner

*Primary Examiner* — David Redding
(74) *Attorney, Agent, or Firm* — Blank Rome LLP

(57) ABSTRACT

A brush assembly for a vacuum cleaner includes a brush body having a suction inlet; a main brush which is rotatably coupled to the brush body through the suction inlet to face a surface being cleaned; and a secondary brush which is rotatably mounted on the brush body to rotate between at least two positions including a first position, in which the secondary brush contacts the surface being cleaned, and a second position, in which the secondary brush does not contact the surface being cleaned.

17 Claims, 4 Drawing Sheets

BRUSH ASSEMBLY AND VACUUM CLEANER HAVING THE SAME

REFERENCE TO RELATED APPLICATION

This application claims the benefit under 35 U.S.C. §119 of Korean Patent Application No. 10-2008-0025613, filed Mar. 19, 2008, in the Korean Intellectual Property Office, the entire disclosure of which is incorporated herein by reference.

FIELD OF THE INVENTION

The present invention relates to a vacuum cleaner, and more particularly to a brush assembly for suctioning in dust-laden air from a surface being cleaned and for separating the dust from the air.

BACKGROUND OF THE INVENTION

A vacuum cleaner generally draws in dust-laden air from a surface being cleaned, separates the dust from the air, and collects the separated dust, using a suction force generated in the vacuum cleaner. Conventional vacuum cleaners include a brush assembly positioned opposite the surface being cleaned. The brush assembly strikes the surface being cleaned to dissipate dust on the surface into the air so that dust-laden air can be drawn into the vacuum cleaner via a suction force.

The brush assembly often includes a rotating brush having bristles protruding from the periphery thereof. The brush removes dust from the surface being cleaned by causing the bristles to strike the surface.

The intensity of the contact of the brush on a surface, such as a wooden floor, is more powerful than on an uneven surface, such as a carpeted floor. The brush cannot satisfactorily remove hair and other long materials from a carpet, which reduces the efficiency of the vacuum cleaner.

SUMMARY OF THE INVENTION

Exemplary embodiments of the present invention address at least the above problems and/or disadvantages and other problems and/or disadvantages not described above. However, the present invention is not required to overcome the disadvantages described above, and embodiments within the scope of the present invention may not overcome any of the problems described above.

According to an exemplary aspect of the present invention, there is provided A brush assembly for a vacuum cleaner, comprising: a brush body comprising a suction inlet; a main brush which is rotatably coupled to the brush body through the suction inlet to face a surface being cleaned; and a secondary brush which is rotatably mounted on the brush body to rotate between at least two positions including a first position, in which the secondary brush contacts the surface being cleaned, and a second position, in which the secondary brush does not contact the surface being cleaned.

The secondary brush may include a rake member comprising a plurality of teeth which are positioned along the suction inlet; and at least one supporting bracket which rotatably connect both ends of the rake member to the brush body. The rake member moves between the at least two positions of the secondary brush.

According to another exemplary aspect of the present invention, there is provided a vacuum cleaner, including a cleaner body which generates a suction force; and a brush assembly which removes dust from a surface being cleaned by drawing dust-laden air into the cleaner body, wherein the brush assembly may include a brush body including a suction inlet; a main brush which is rotatably coupled to the brush body at the suction inlet to face the surface; and a secondary brush which is rotatably mounted on the brush body to rotate between at least two positions including a first position, in which the secondary brush contacts the surface being cleaned, and a second position, in which the secondary brush does not contact the surface being cleaned.

According to another exemplary aspect of the present invention, there is provided a brush assembly of a vacuum cleaner, including a main brush which is rotatably coupled to the brush body at the suction inlet to face a surface being cleaned; and a secondary brush which is rotatably mounted on the brush body, and which can rotate to contact the surface being cleaned.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF EXEMPLARY EMBODIMENTS OF THE INVENTION

Figure 1:
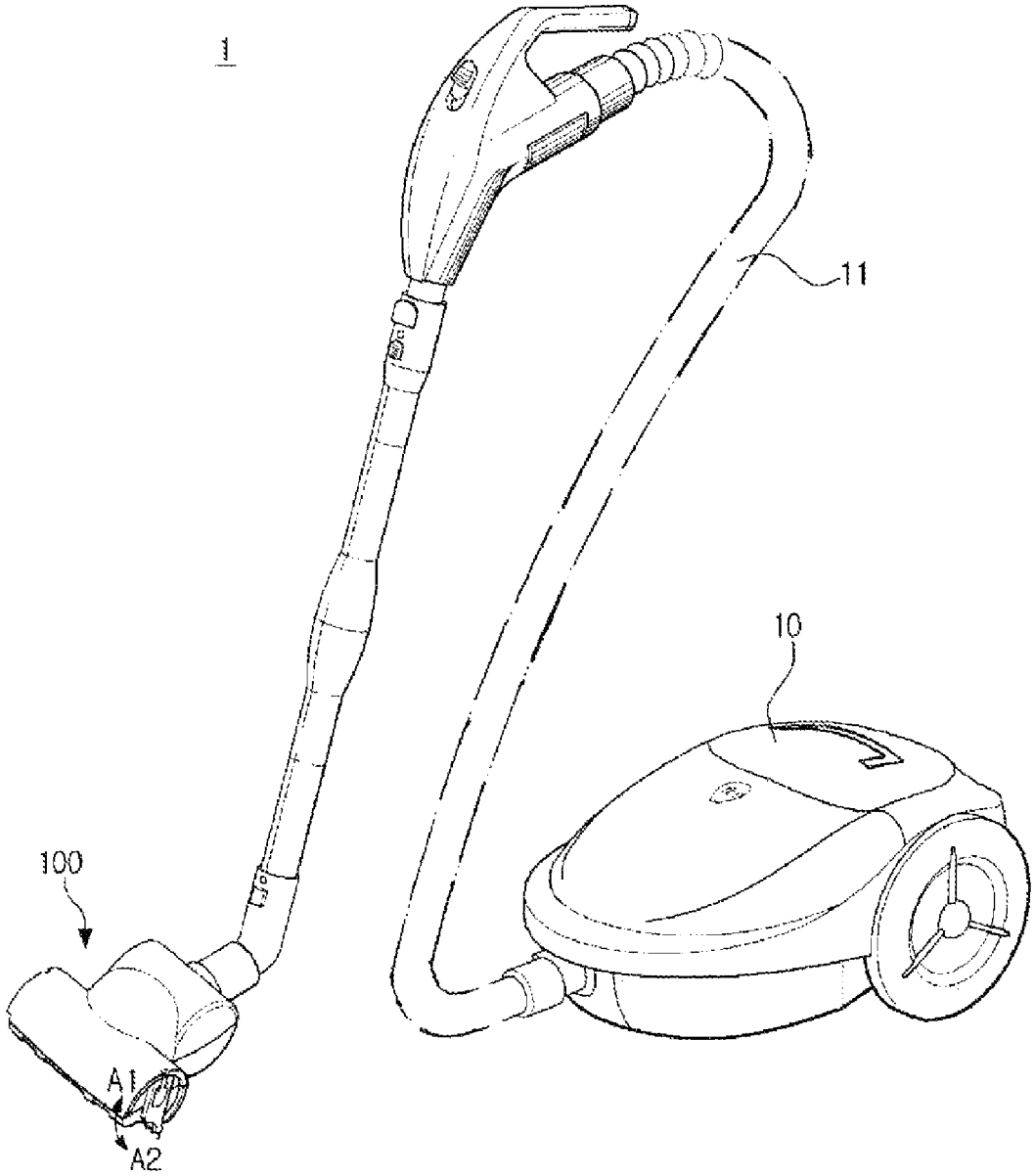
FIG. 1 is a perspective view illustrating a vacuum cleaner according to an exemplary embodiment of the present invention.

Certain exemplary embodiments of the present invention will now be described in greater detail with reference to the accompanying drawings.

In the following description, the same drawing reference numerals are used for the same elements in different drawings. The matters defined in the description, such as detailed construction and elements, are provided to assist in a comprehensive understanding of the invention. Thus, it is apparent that the present invention can be carried out without those specifically defined matters. Also, well-known functions or constructions are not described in detail since they would obscure the invention with unnecessary detail.

FIG. 1 is a perspective view illustrating a vacuum cleaner according to an exemplary embodiment of the present invention.

Referring to FIG. 1, a vacuum cleaner 1 of the present invention includes a cleaner body 10 and a brush assembly 100. The brush assembly 100 is capable of changing the type of brush in use according to the condition of a surface being cleaned, and a vacuum cleaner having the same.

The cleaner body 10 houses a suction force generation mechanism (not shown), such as a suction motor, to draw in dust-laden air, and a dust separating means to separate dust from the air and to collect the separated dust. Functions of the parts housed in the cleaner body 10 are well known to those skilled in the art, so a detailed description is omitted for the sake of brevity.

The brush assembly 100 travels along a surface, and removes dust from the surface. The brush assembly 100 is in fluid communication with the cleaner body 10 through an extension pipe 11, and suctions in dust which is removed from the surface being cleaned using a suction force generated in the cleaner body 10. The dust suctioned in by the brush assembly 100 is drawn into the cleaner body 10 through the extension pipe 11, and is separated from the air by the dust separating means.

Figure 2:
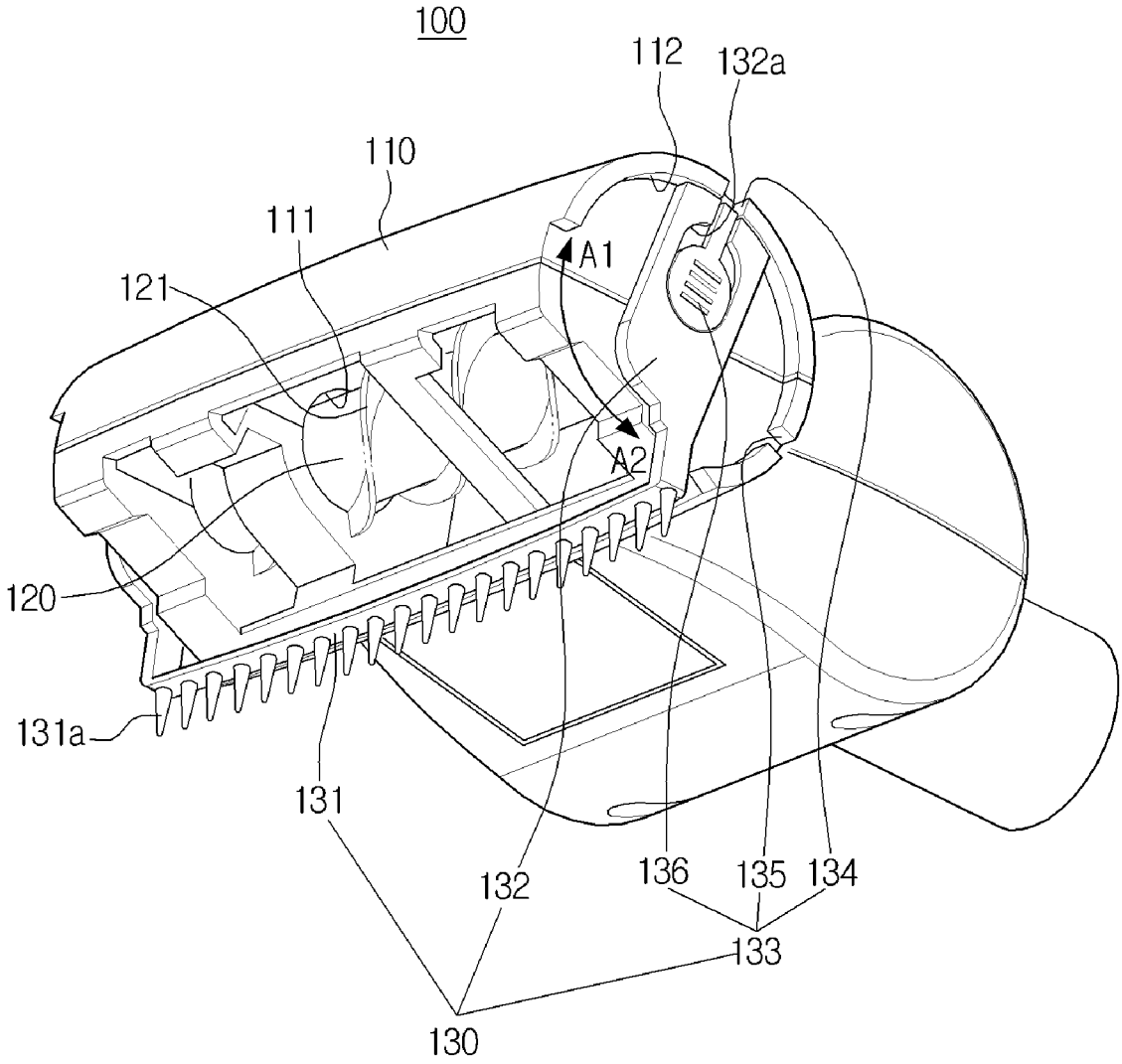
FIG. 2 is a bottom perspective view illustrating a brush assembly of the vacuum cleaner of FIG. 1.

Referring to FIG. 2, the brush assembly 100 includes a brush body 110, a main brush 120, and a secondary brush 130. The brush body 110 includes a suction inlet 111 which faces a surface being cleaned, and one surface of which is open. Both ends of the main brush 120 are rotatably supported on inner surfaces of the brush body 110, and are external to the suction inlet 111. Bristles 121 are positioned on a periphery of the main brush 120. The bristles 121 of the main brush 120 rotate while contacting the surface being cleaned, and thereby remove dust from the surface.

While the bristles 121 are positioned on the periphery of the main brush 120 in this exemplary embodiment of the present invention, as an alternative blades may be formed on the periphery of the main brush 120.

The secondary brush 130 may be rotatably mounted on the brush body 110 so that either the secondary brush 130 or the main brush 120 is in operation. The secondary brush 130 is coupled to the brush body 110 so that the secondary brush 130 can rotate between a first position, in which it contacts the surface being cleaned, and a second position, in which it does not contact the surface being cleaned.

Figure 4A:
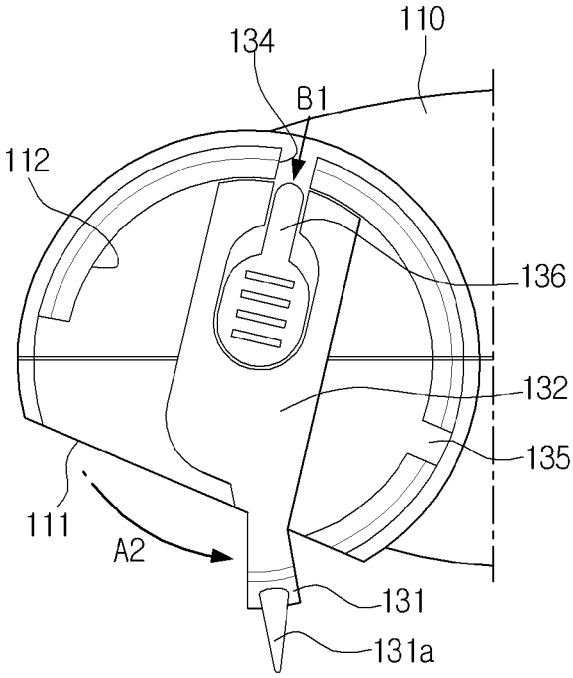
FIGS. 4A and 4B are side views illustrating the brush assembly of FIG. 2, and showing a rake member in a cleaning position.
Figure 4B:
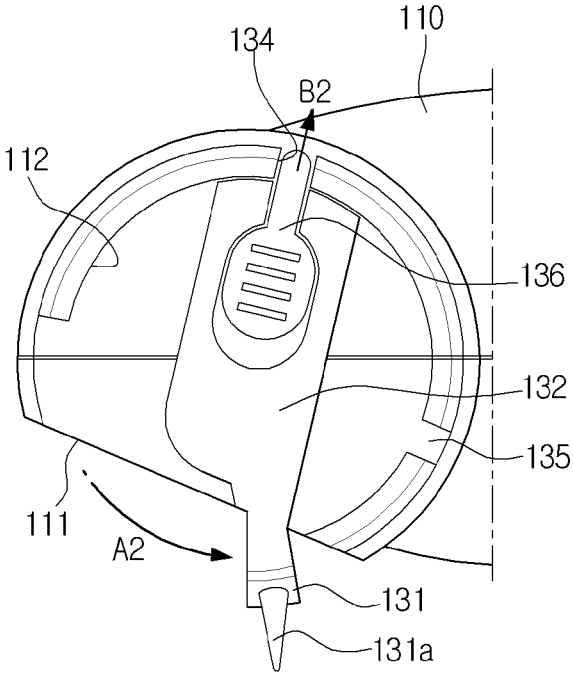

The secondary brush 130 may include a rake member 131, at least one supporting bracket 132, and a stopper 133. The rake member 131 rakes the surface, such as a carpet, in a manner similar to a brush in order to remove dust from the surface. As seen in FIGS. 2, 4A and 4B, the rake member 131 is preferably located under the main brush 120 when the secondary brush 130 is in the first position of contacting the surface to be cleaned. A plurality of teeth 131*a* are formed on the periphery of the rake member 131 along the suction inlet 111 and facing the surface being cleaned. The plurality of teeth 131*a* may be formed of rubber.

The supporting bracket 132 rotatably supports the rake member 131 on the brush body 110. The supporting bracket 132 is formed integrally with both ends of the rake member 131, is housed in a recess 112, and is inserted into the ends of the brush body 110 so as to be rotatable in a direction indicated by arrow A1 or A2. The stopper 133 prevents the rake member 131 from rotating when not intended by a user, and includes first and second fixing grooves 134 and 135, respectively, and a fixing member 136.

The first and second fixing grooves 134 and 135 are formed on a portion adjacent to the recess 112 of the brush body 110 to correspond to the first and second positions, respectively, of the rake member 131. Hereinbelow, for convenience of description, the first fixing groove 134 corresponds to the first position of the rake member 131, and the second fixing groove 135 corresponds to second position of the rake member 131.

In this exemplary embodiment of the present invention, the rake member 131 rotates between two positions, that is, the first position in which the surface is cleaned, and the second position, in which the surface is not cleaned, and the corresponding two fixing grooves 134 and 135 are provided. Alternatively, the rake member 131 can be situated in five positions, for example, three positions in which the surface is cleaned and two positions in which the surface is not cleaned, and five fixing grooves are provided to correspond to the number of the positions. However, the present invention is not limited to the above arrangements.

The fixing member 136 is slidably mounted on the supporting bracket 132 to be fitted into the first or second fixing groove 134 or 135, and to prevent rotation of the supporting bracket 132. The fixing member 136 is mounted on the supporting bracket 132 in order to be slid between a first location, in which the fixing member 135 is inserted into the first or second fixing groove 134 or 135 in a direction indicated by arrow B1 or B2, and a second location, in which the fixing member 135 is not inserted into the first or second fixing groove 134 or 135. A guide groove 132*a* may be formed on each supporting bracket 132 to guide the fixing member 136 in the direction indicated by arrow B1 or B2.

The operation of the brush assembly 100 of the vacuum cleaner according to an exemplary embodiment of the present invention will be explained below.

Figure 3A:
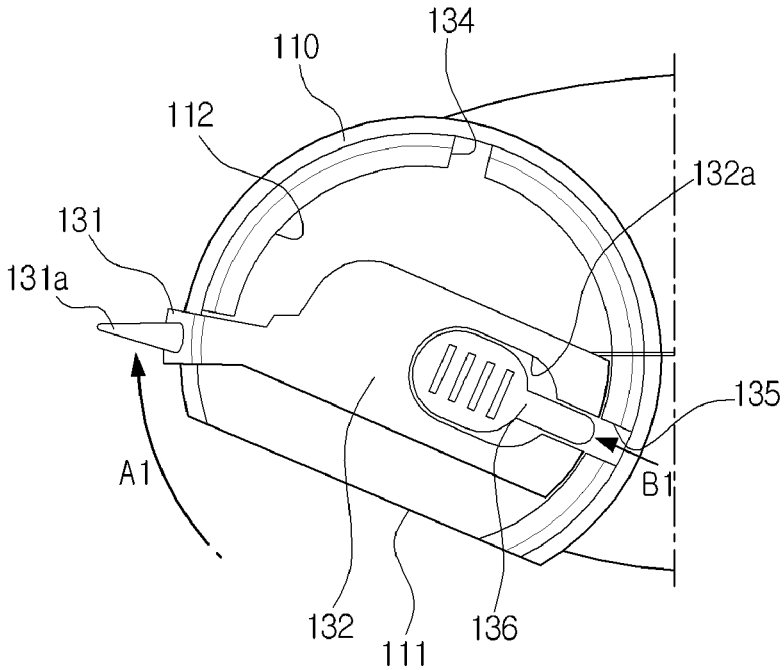
FIGS. 3A and 3B are side views illustrating the brush assembly of FIG. 2, and showing a rake member in a non-cleaning position.
Figure 3B:
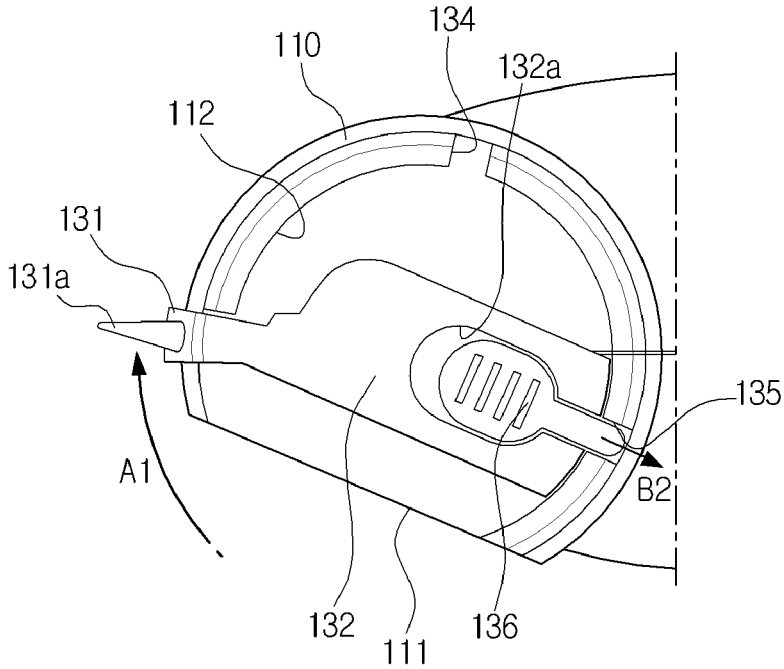

When cleaning a flat surface, such as a wooden floor, the rake member 131 may be rotated in the direction indicated by arrow A1 about the brush body 110, as shown in FIGS. 3A and 3B, so that only the main brush 120 is used to remove the dust from the surface.

While the rake member 131 rotates in the direction indicated by arrow A1, the fixing member 136 slides in the direction indicated by arrow B1, rotates to be opposite the second fixing groove 135, and slides in the direction indicated by arrow B2, in order to be fixedly inserted into the second fixing groove 135. By doing so, the fixing member 136 prevents the supporting bracket 132 from further movement, and the rake member 131 remains at the second position, where it is not used to clean a surface. Accordingly, the rake member 131 does not interfere with the operation of the main brush 120.

When cleaning an uneven surface, such as a carpeted floor, the rake member 131 may be rotated in the direction indicated by arrow A2, as shown in FIGS. 4A and 4B, to be placed at the first position so as to be in contact with the surface being cleaned. The fixing member 136 is detached from the second fixing groove 135 by being slid in the direction indicated by arrow B1, rotates together with the rake member 131 in the direction indicated by arrow A2, and is fixedly inserted into the first fixing groove 134 by being slid in the direction indicated by arrow B2. The rake member 131 is fixed at the first position and unintentional rotation of the rake member 131 is prevented.

The dust removed from the surface being cleaned by the main brush 120 or the secondary brush having the rake member 131 is drawn into the cleaner body 10 connected through the extension pipe 11, and is separated by a separating means (not shown).

According to the exemplary embodiment of the present invention, due to the main brush, which always contacts the surface being cleaned, and the secondary brush, which selectively contacts the surface being cleaned, a user can selectively use a desired brush according to the conditions of the surface to be cleaned. Therefore, the user can use the vacuum cleaner conveniently, and cleaning efficiency is enhanced.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A brush assembly for a vacuum cleaner, comprising:

a brush body comprising a suction inlet;

a main brush which is rotatably coupled to the brush body at the suction inlet to face a surface being cleaned; and a secondary brush which is rotatably mounted on the brush body, the secondary brush being configured to rotate between at least two positions including a first position, in which the secondary brush contacts the surface being cleaned, and a second position, in which the secondary brush does not contact the surface being cleaned, wherein part of the secondary brush is located under the main brush when the secondary brush is in the first position.

2. The brush assembly of claim 1, wherein the secondary brush comprises:

a rake member comprising a plurality of teeth which are positioned along the suction inlet and which rotates between the at least two positions; and at least one supporting bracket which rotatably connects both ends of the rake member to the brush body.

3. The brush assembly of claim 2, wherein the plurality of teeth are made of rubber.

4. The brush assembly of claim 2, wherein the supporting bracket is rotatably mounted in a recess which is formed in both ends of the brush body.

5. The brush assembly of claim 4, wherein the secondary brush further comprises:

a stopper which prevents the rake member from rotating.

6. The brush assembly of claim 5, wherein the stopper comprises:

at least two fixing grooves which are formed on a portion adjacent to the recess in the brush body to correspond to the at least two positions of the rake member; and a fixing member which is movably disposed on the supporting bracket so as to be selectively fitted into the at least two fixing grooves.

7. The brush assembly of claim 6, wherein the fixing member is mounted on the supporting bracket in order to be slid between a first location, in which the fixing member is inserted into the fixing groove, and a second location, in which the fixing member is not inserted into the fixing groove.

8. A vacuum cleaner, comprising:

a cleaner body which generates a suction force; and a brush assembly which removes dust from a surface being cleaned by drawing in dust-laden air into the cleaner body, the brush assembly including:

a brush body including a suction inlet;

a main brush which is rotatably coupled to the brush body at the suction inlet to face the surface; and a secondary brush which is rotatably mounted on the brush body, the secondary brush being configured to rotate between at least two positions including a first position, in which the secondary brush contacts the surface being cleaned, and a second position, in which the secondary brush does not contact the surface being cleaned, wherein part of the secondary brush is located under the main brush when the secondary brush is in the first position.

9. The vacuum cleaner of claim 8, wherein the secondary brush comprises:

a rake member comprising a plurality of teeth which are positioned along the suction inlet and which rotates between the at least two positions; and at least one supporting bracket which rotatably connects both ends of the rake member to the brush body.

10. The vacuum cleaner of claim 9, wherein the plurality of teeth are made of rubber.

11. The vacuum cleaner of claim 9, wherein the supporting bracket is rotatably mounted in a recess which is formed in both ends of the brush body.

12. The vacuum cleaner of claim 11, wherein the secondary brush further comprises:

a stopper which prevents the rake member from rotating.

13. The vacuum cleaner of claim 12, wherein the stopper comprises:

at least two fixing grooves which are formed on a portion adjacent to the recess in the brush body to correspond to the at least two positions of the rake member; and a fixing member which is movably disposed on the supporting bracket so as to be selectively fitted into the at least two fixing grooves.

14. The vacuum cleaner of claim 13, wherein the fixing member is mounted on the supporting bracket in order to be slid between a first location, in which the fixing member is inserted into the fixing groove, and a second location, in which the fixing member is not inserted into the fixing groove.

15. The vacuum cleaner of claim 8, further comprising:

an extension pipe which connects the brush assembly to the cleaner body.

16. A brush assembly for a vacuum cleaner, comprising:

a main brush which is rotatably coupled to the brush body at the suction inlet to face a surface being cleaned; and a secondary brush which is rotatably mounted on the brush body, and which rotates to contact the surface being cleaned, the secondary brush being located under the main brush when the secondary brush is in contact with the surface being cleaned.

17. The brush assembly of claim 16, wherein the secondary brush comprises:

a stopper which prevents the secondary brush from rotating.

* * * * *